US005816061A

United States Patent [19]

Lee et al.

[11] Patent Number: 5,816,061

[45] Date of Patent: Oct. 6, 1998

[54] METHOD AND APPARATUS FOR CONTROLLING THE TEMPERATURE OF THE REFRIGERATING CHAMBER OF A REFRIGERATOR

[75] Inventors: Geun Ho Lee; Seung Myung Baek, both of Kyungsangnam-do, Rep. of Korea

[73] Assignee: LG Electronics Inc., Seoul, Rep. of Korea

[21] Appl. No.: 731,749

[22] Filed: Oct. 18, 1996

[30] Foreign Application Priority Data

Oct. 18, 1995 [KR] Rep. of Korea ..... 1995/35985
Dec. 7, 1995 [KR] Rep. of Korea ..... 1995/47382

[51] Int. Cl.[6] ..... F25D 17/04

[52] U.S. Cl. ..... 62/187; 62/407; 236/51

[58] Field of Search ..... 62/186, 187, 407; 236/51

[56] References Cited

U.S. PATENT DOCUMENTS 4,704,874 11/1987 Thompson et al. ..... 62/187
4,876,860 10/1989 Negishi ..... 62/186 X
5,172,566 12/1992 Jung et al. ..... 62/186
5,331,825 7/1994 Kim ..... 62/180
5,398,599 3/1995 Woo ..... 62/187 X
5,664,437 9/1997 Park et al. ..... 62/407

*Primary Examiner*—Henry A. Bennett
*Assistant Examiner*—Susanne C. Tinker

[57] ABSTRACT

An apparatus and method for controlling the temperature in a refrigerating chamber of a refrigerator by supplying appropriate cooled air to each of the compartments of the refrigerating chamber according to a temperature in each of the compartments. A cooled air controlling plate is provided for controlling the size of the cooled air discharge outlet according to the individual temperatures in the compartments. The cooled air controlling plate is moved in an up and down direction in multiple stages depending on the temperature in the refrigerating chamber to control the cooled air discharge rate to each of the compartments of the refrigerating chamber so as to make the temperature in the refrigerating chamber uniform.

19 Claims, 19 Drawing Sheets convertional art convertional art position information

| NO. | 60A | 60B | 60C | 60D |
|---|---|---|---|---|
| ① | S | S | S | S |
| ② | S | W | S | S |
| ③ | S | W | W | S |
| ④ | S | S | W | S |
| ⑤ | S | S | S | W |
| ⑥ | S | W | S | W |
| ⑦ | S | W | W | W |
| ⑧ | S | S | W | W |
| ⑨ | OFF | OFF | OFF | OFF |

S: strong
W: weak

FIG.15

1 : higher than preset temp.
0 : lower than preset temp.

| temperature sensor1 temperature | temperature sensor2 temperature | temperature sensor3 temperature | states of cooled air distribution guide |
|---|---|---|---|
| 0 | 0 | 0 | ⓔ position |
| 0 | 0 | 1 | ⓓ position |
| 0 | 1 | 0 | ⓒ position |
| 0 | 1 | 1 | ⓒ position |
| 1 | 0 | 0 | ⓑ position |
| 1 | 0 | 1 | ⓑ position |
| 1 | 1 | 0 | ⓑ position |
| 1 | 1 | 1 | rotate |

METHOD AND APPARATUS FOR CONTROLLING THE TEMPERATURE OF THE REFRIGERATING CHAMBER OF A REFRIGERATOR

BACKGROUND OF THE INVENTION

1. Field of the Invention

The present invention relates to a method and apparatus for controlling the temperature of the refrigerating chamber of a refrigerator which supplies appropriate cooling air to each shelf of the refrigerating chamber according to the desired temperature condition.

2. Discussion of the Related Art

A conventional device for controlling the temperature of a refrigerating chamber will be explained with reference to the attached drawings.

Referring to FIG. 1, a conventional device for controlling the refrigerating chamber temperature includes a freezing chamber temperature sensing part 1 for sensing the temperature in the freezing chamber, a refrigerating chamber temperature sensing part 2 for sensing the temperature of the refrigerating chamber, a user input part 3 for allowing a user to select and set functions of the refrigerator, an analog-to-digital converting part 4 for converting the analog temperature signals from the freezing and refrigerating chamber temperature sensing parts 1 and 2, an input interface part 5 for receiving external signal from the user input part 3, a central processing part 6 for controlling the different parts required for controlling temperatures in the freezing and refrigerating chambers, a calculating part 7 in charge of calculating function under the control of the central processing part 6, a memory part 8 for storing input and output data and various data, an output interface part 9 for transmitting internal signals to external devices, a display part 10 for displaying the operating condition of the refrigerator to the user, a compressor driving part 11 for compressing the refrigerant, a cooling fan driving part 12 for driving a cooling fan for blowing out cooled air, and a refrigerating chamber damper driving part 13 for controlling the refrigerating chamber damper for blocking or passing flow of the cooled air from the freezing chamber to the refrigerating chamber according to the temperature of the refrigerating chamber.

The input interface part 5, central processing part 6, calculating part 7, memory part 8, and output interface part 9 are included in a microcomputer 6*a* which controls the entire system.

The operation of the conventional device for controlling a refrigerating chamber temperature having the aforementioned system will be explained in detail.

Referring to FIGS. 2 and 3, the freezing chamber 20 and refrigerating chamber 30 have partition members, such as shelves 16, for dividing the chambers into predetermined spaces. The refrigerating chamber damper 13A blocks or passes cooled air flowing from the freezing chamber 20 to the refrigerating chamber 30, and cooled air outlets 15A~15D discharge the cooled air into each of the spaces in the refrigerating chamber 30 for cooling these spaces.

When a user sets a temperature of the freezing chamber 20 or the refrigerating chamber 30 using the user input part 3, the input interface part 5 transfers it to the central processing part 6, and the central processing part 6 drives the compressor driving part 11 through the output interface part 9 to compress refrigerant for cooling air in the freezing chamber 20.

In order to allow the air thus cooled to flow into the refrigerating chamber 30, the central processing part 6 controls the refrigerating chamber damper driving part 13 to open the refrigerating chamber damper 13A, and controls the cooling fan driving part 12 to drive a cooling fan 12A to blow out the air cooled in the freezing chamber 20 into the refrigerating chamber 30. The cooled air then flows into a cooled air passage 14 and discharges through each of the cooled air discharge outlets 15A, 15B, 15C, and 15D on one side of the refrigerating chamber 30 divided by the shelves 16 to cool each of the spaces 30A, 30B, 30C, and 30D of the refrigerating chamber 30.

The temperatures in the freezing chamber 20 and the refrigerating chamber 30 are sensed by the freezing chamber temperature sensing part 1 and the refrigerating chamber temperature sensing part 2, respectively, digitized by the analog/digital converting part 4, and transmitted to the central processing part 6.

Then, the central processing part 6 compares the temperatures in the freezing chamber 20 and the refrigerating chamber 30 sensed by the temperature sensing parts 1 and 2, respectively, to the temperatures preset by the user. If the temperature in the refrigerating chamber 30 is found higher than the temperature preset by the user as a result of the comparison, the central processing part 6 drives the cooling fan 12A through the cooling fan driving part 12 to blow the cooled air in the freezing chamber 20 out to the refrigerating chamber 30 and opens the refrigerating chamber damper 13A through the refrigerating chamber damper driving part 13 to move the cooled air blown out from the freezing chamber 20 to the refrigerating chamber 30.

The cooled air thus blown into the refrigerating chamber 30 is distributed in the refrigerating chamber 30 according to sizes of the cooled air discharging outlets 15A, 15B, 15C, and 15D, and cools the refrigerating chamber 30. Thus, the temperature preset by the user can be reached.

When the temperature in the refrigerating chamber 30 is lower than the temperature preset by the user, the central processing part 6 controls the cooling fan 12A to stop and the refrigerating chamber damper 13A to close, thereby blocking the cooled air flowing from the freezing chamber 20 to the refrigerating chamber 30.

However, in the aforementioned conventional device, in which the damper is closed to cut off flow-in of cooled air when the temperature in the refrigerating chamber is lower than the preset temperature, and the damper is opened to allow passage of the cooled air when the temperature in the refrigerating chamber is higher than the preset temperature, as the rate of air distribution to each of the spaces between the shelves is dependent on the sizes of the cooled air discharge outlets, the conventional temperature controlling device has a problem in that the spaces cannot be cooled individually and efficiently depending on the temperature and the cooling load of each of the spaces between the shelves.

SUMMARY OF THE INVENTION

Accordingly, the present invention is directed to a method and apparatus for controlling the temperature of a refrigerating chamber in a refrigerator that substantially obviates one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages in accordance with the purpose of the present invention, as embodied and broadly described, the method and apparatus for controlling the temperature in a refrigerating chamber of a refrigerator for supplying appropriate cooled air to each of the compartments of the refrigerating chamber according to the temperature in each of the compartments comprises a cooled air controlling plate which is provided for controlling the sizes of cooled air discharge outlets for respective spaces according to individual temperatures of the compartments. The air controlling plate can be moved in an up and down direction in multiple stages depending on the temperature in the refrigerating chamber for controlling the cooled air discharge rate to each of the compartments of the refrigerating chamber to make the temperature in the refrigerating chambers uniform. Cooled air is discharged intensively to the compartment in which the temperature is high, according to the individual temperatures of the compartments, to quickly cool down the compartment and make the temperature in the refrigerating chamber uniform. The cooled air distribution guide is provided for the intensive supply of cooled air to the area in which new food is stored, causing a temperature rise, for always keeping the temperature in the refrigerating chamber uniform.

It is to be understood that both the foregoing general description and the following detailed description are merely exemplary and explanatory and are not intended to limit the scope of the present invention.

BRIEF DESCRIPTION OF THE DRAWINGS

The accompanying drawings, which are included to provide a further understanding of the present invention and are incorporated in and constitute a part of the present specification, illustrate embodiments of the present invention and together with the description, serve to explain the principles of the present invention.

In the drawings:

FIG. 15 illustrates states of the cooled air distributing guide in the cooled air distribution device for controlling the temperature in the refrigerating; chamber of FIG. 11;

DETAILED DESCRIPTION OF THE PREFERRED EMBODIMENT

Reference will now be made in detail to the preferred embodiments of the present invention, examples of which are illustrated in the accompanying drawings.

First Embodiment

Figure 1:
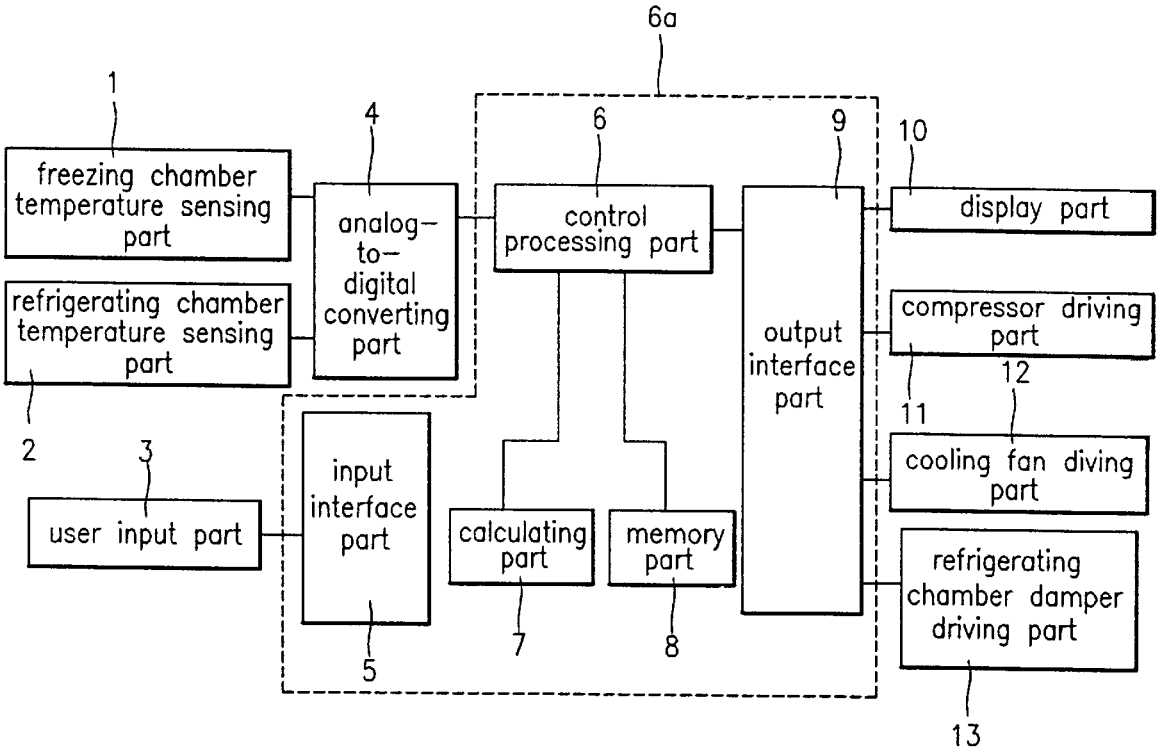
FIG.1 conventional art
FIG. 1 illustrates a conventional system for controlling the temperature of a refrigerating chamber in a refrigerator.
Figure 2:
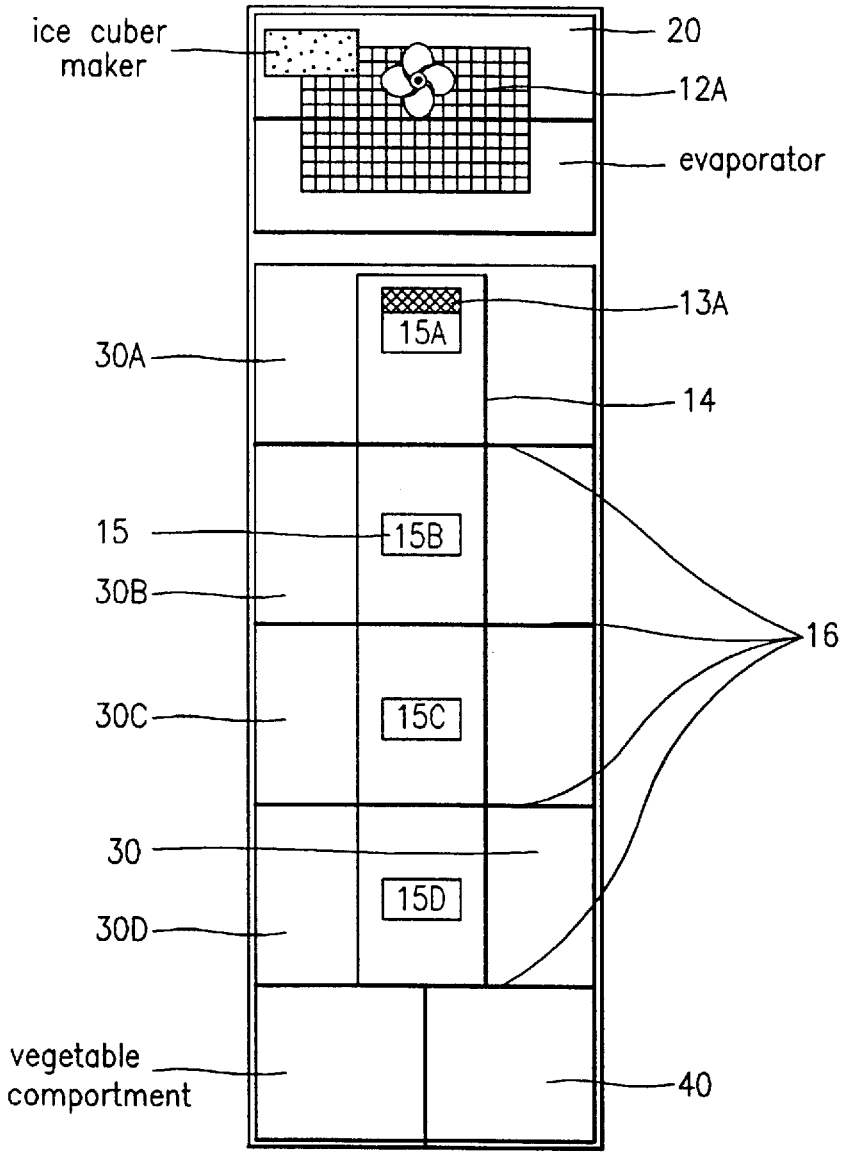
FIG. 2 illustrates a conventional arrangement for separating the refrigerating and freezing chambers by partition members.
Figure 3:
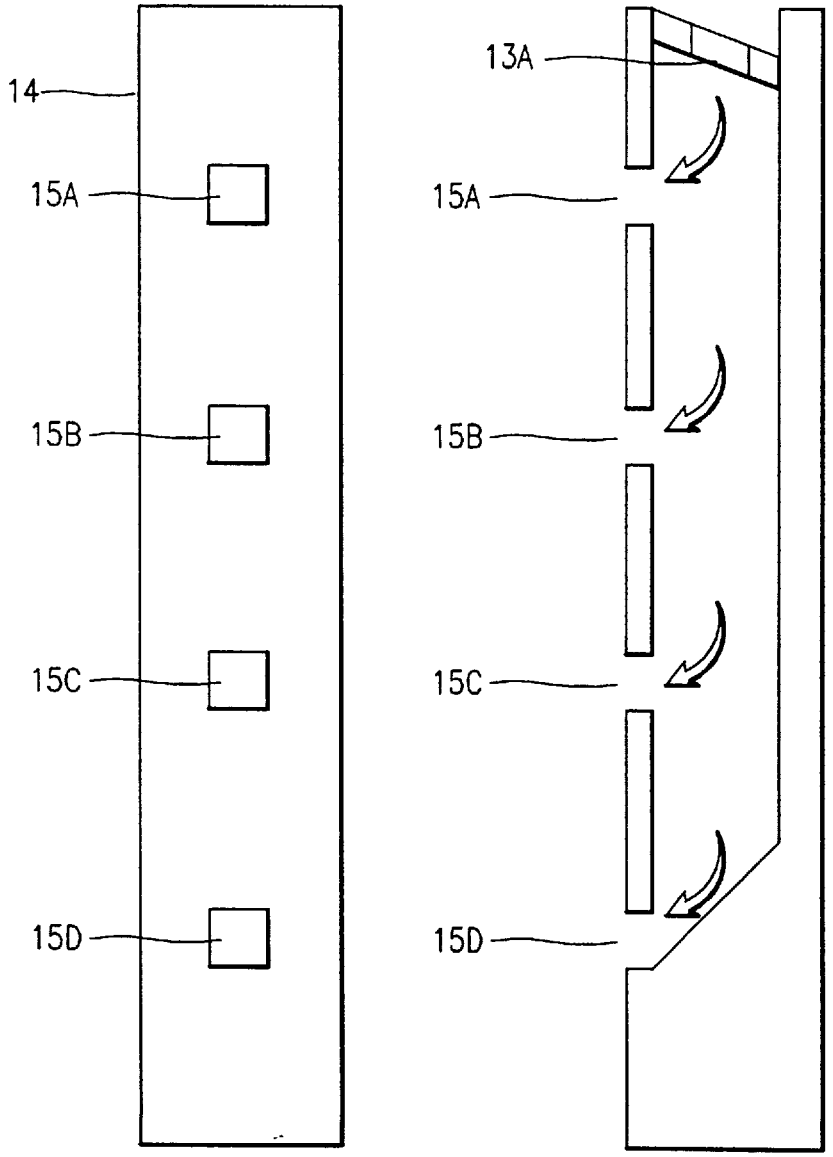
FIG. 3 illustrates details of a conventional arrangement of cooled air discharge outlets.
Figure 4:
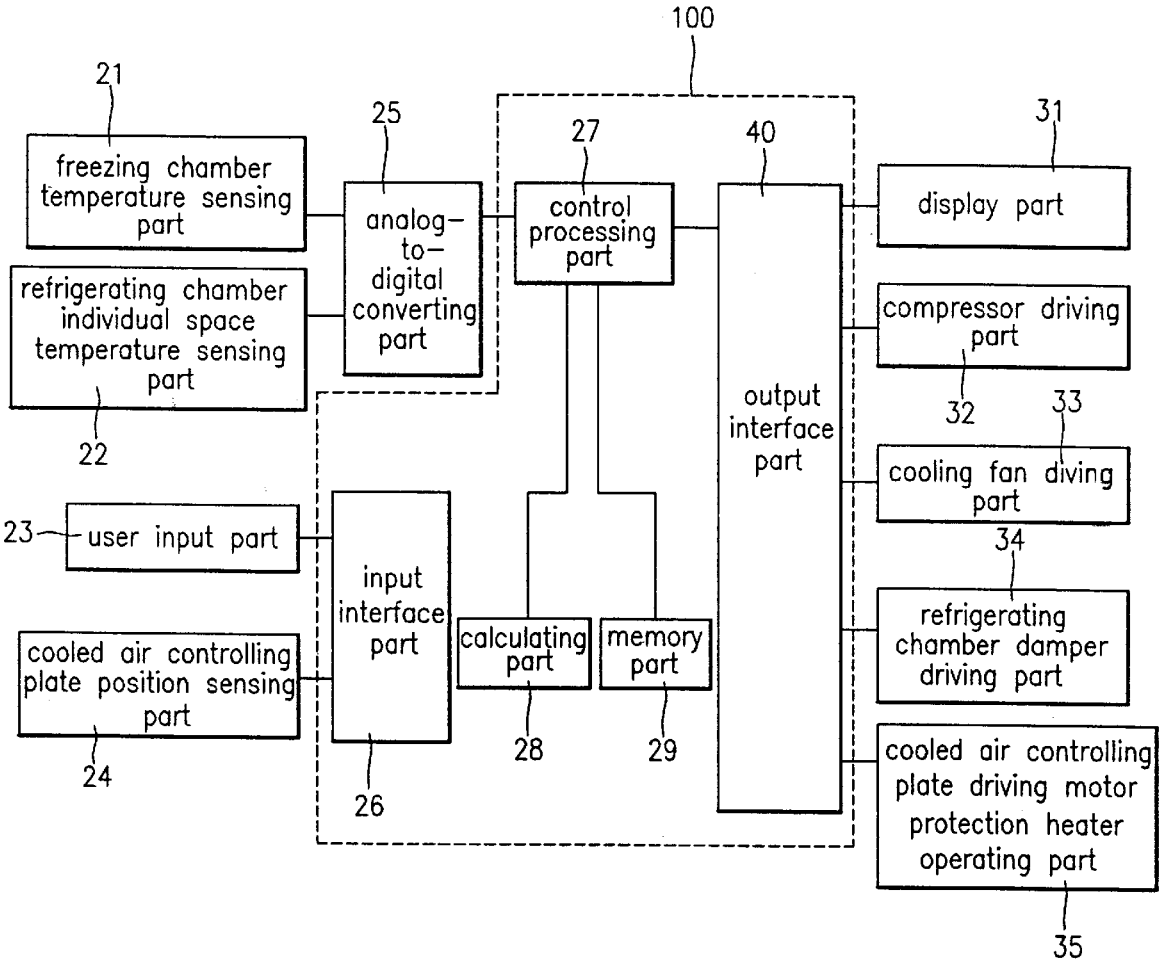
FIG. 4 illustrates a system for controlling the temperature of a refrigerating chamber in a refrigerator in accordance with the first embodiment of the present invention.
Figure 5:
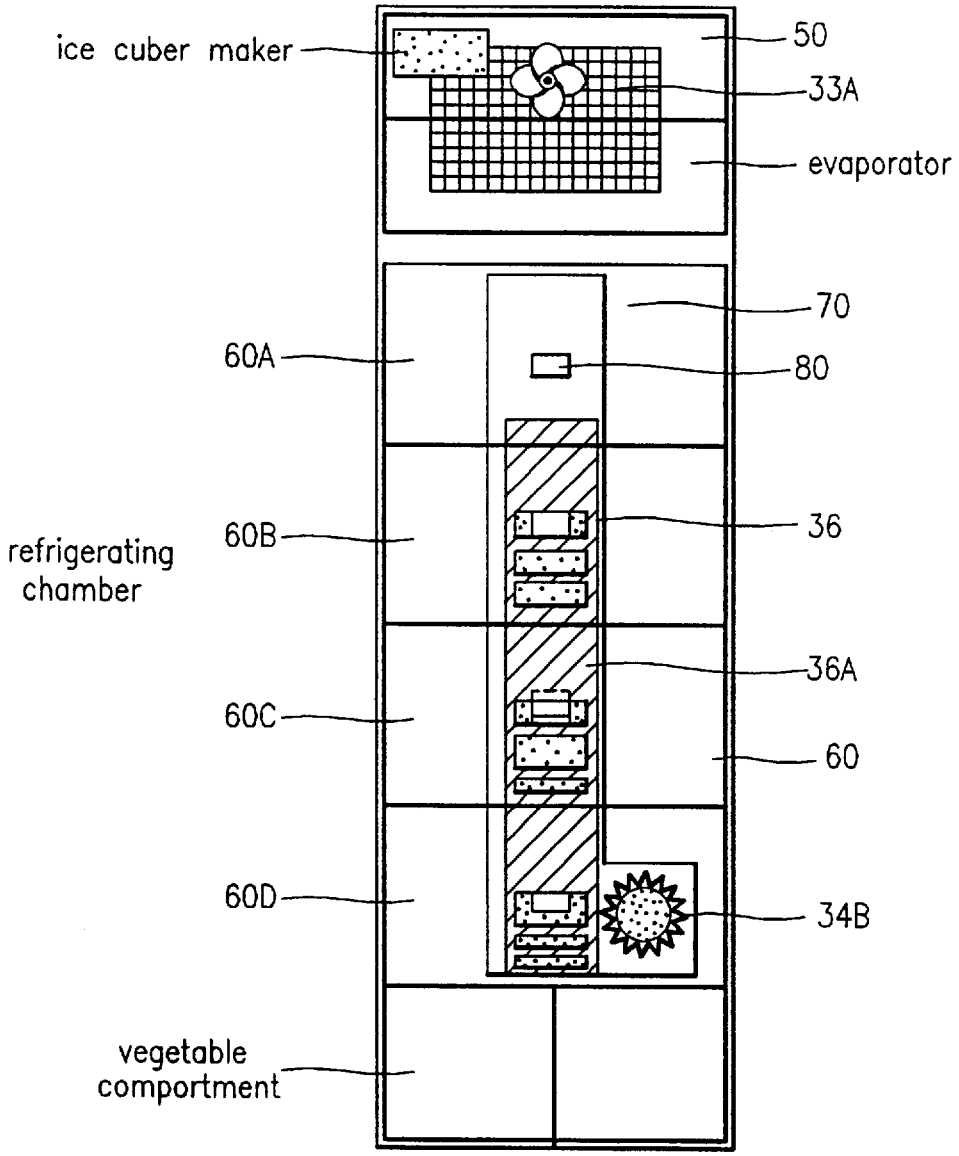
FIG. 5 illustrates an arrangement of cooled air discharge outlet controlling openings for the spaces between the shelves in the refrigerating chamber of the system shown in FIG. 4.
Figure 6:
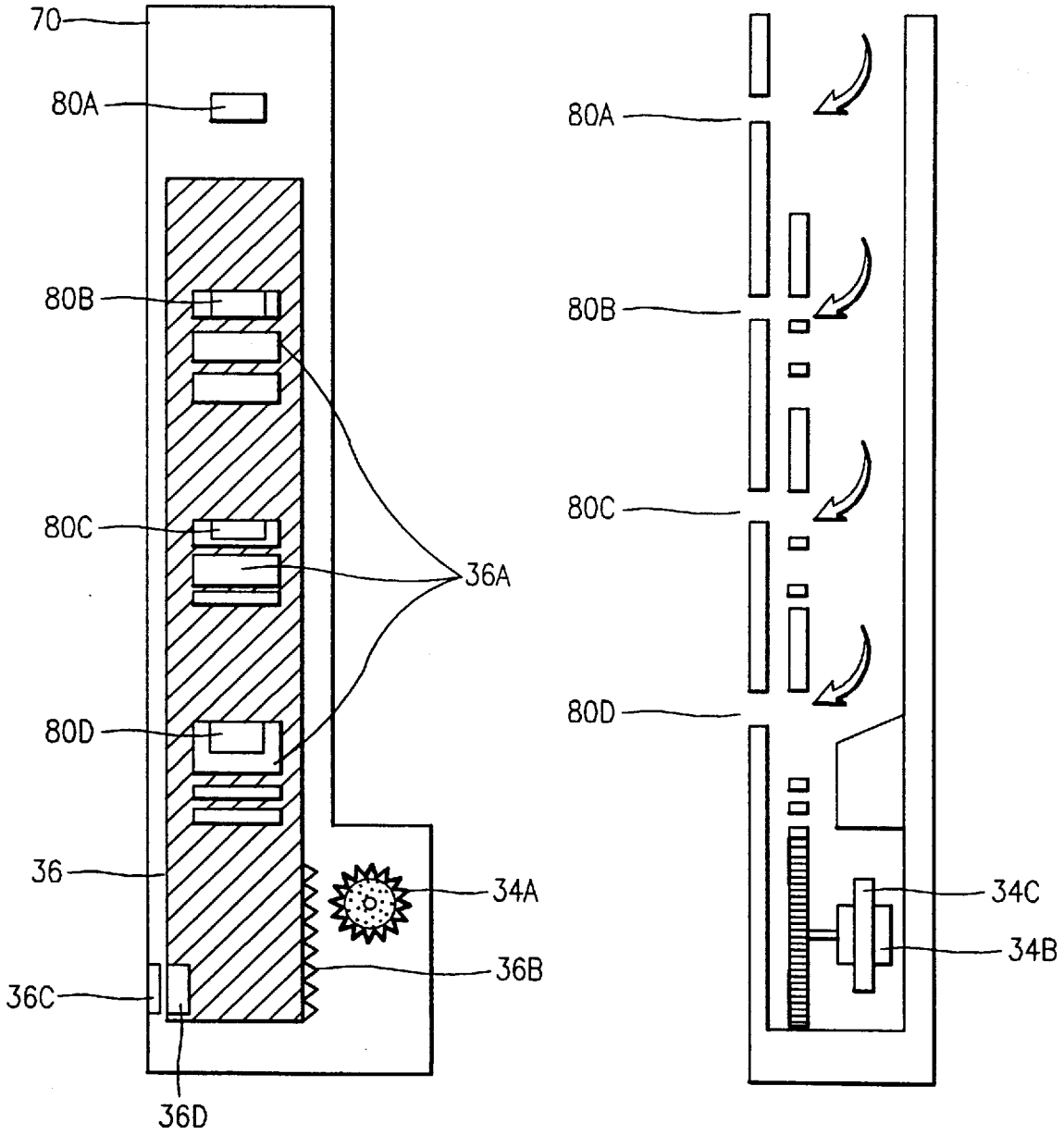
FIG. 6 illustrates an arrangement of cooled air controlling plates of the system shown in FIG. 4.
Figure 7:
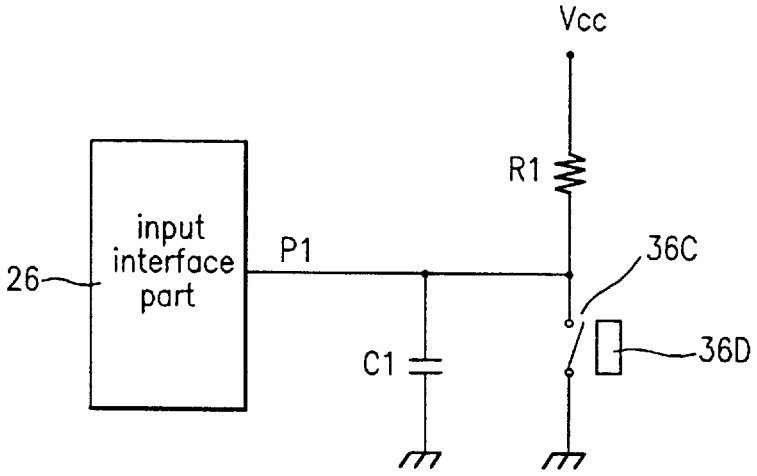
FIG. 7 illustrates a circuit for detecting the position of the cooled air controlling plate shown in FIG. 6.
Figure 8:
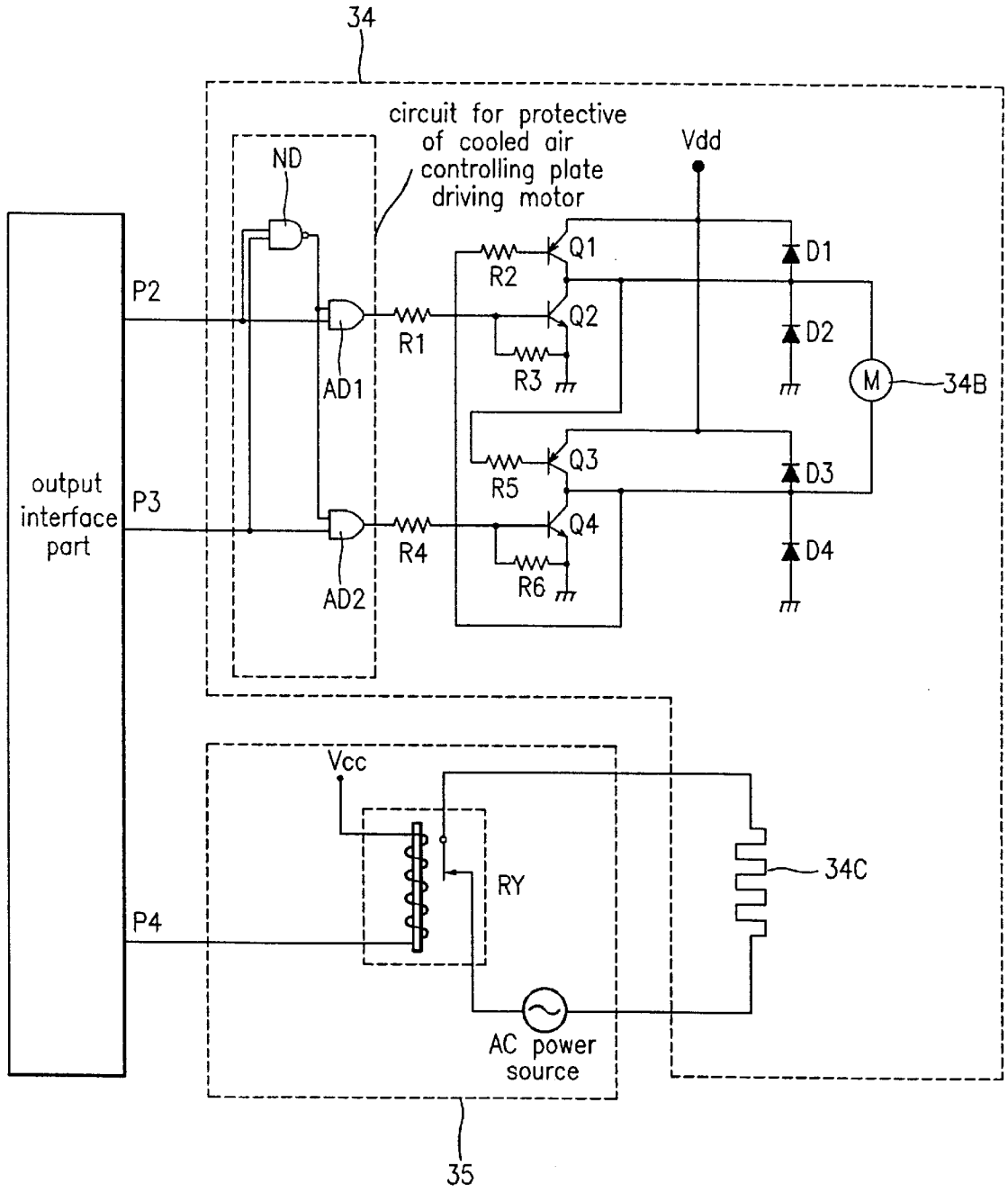
FIG. 8 illustrates a circuit diagram showing the cooled air controlling plate motor driving part and the motor protection heater operating part in the system shown in FIG. 4.
Figure 9A:
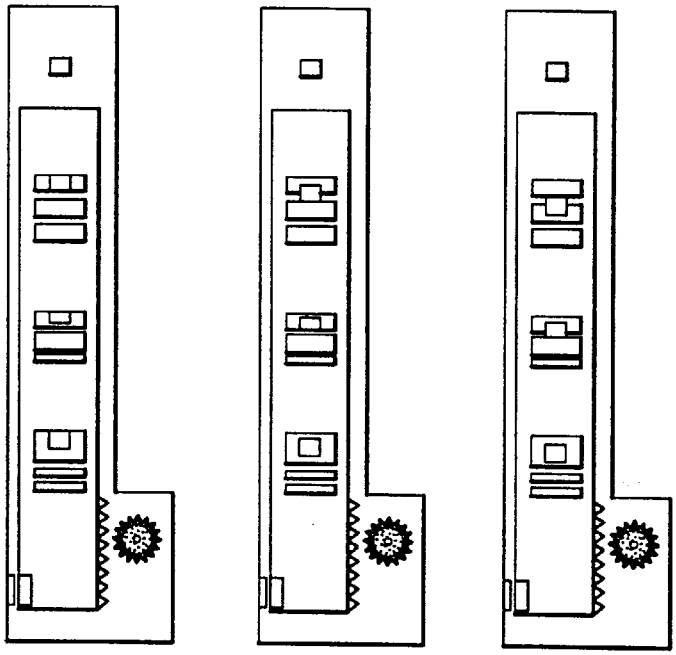
FIG. 9A and FIG. 9B illustrate an example of a multiple stage cooled air discharge rate control system which corresponds to the temperatures of the spaces between the shelves in the refrigerating chamber of the system shown in FIG. 4.
Figure 9B:
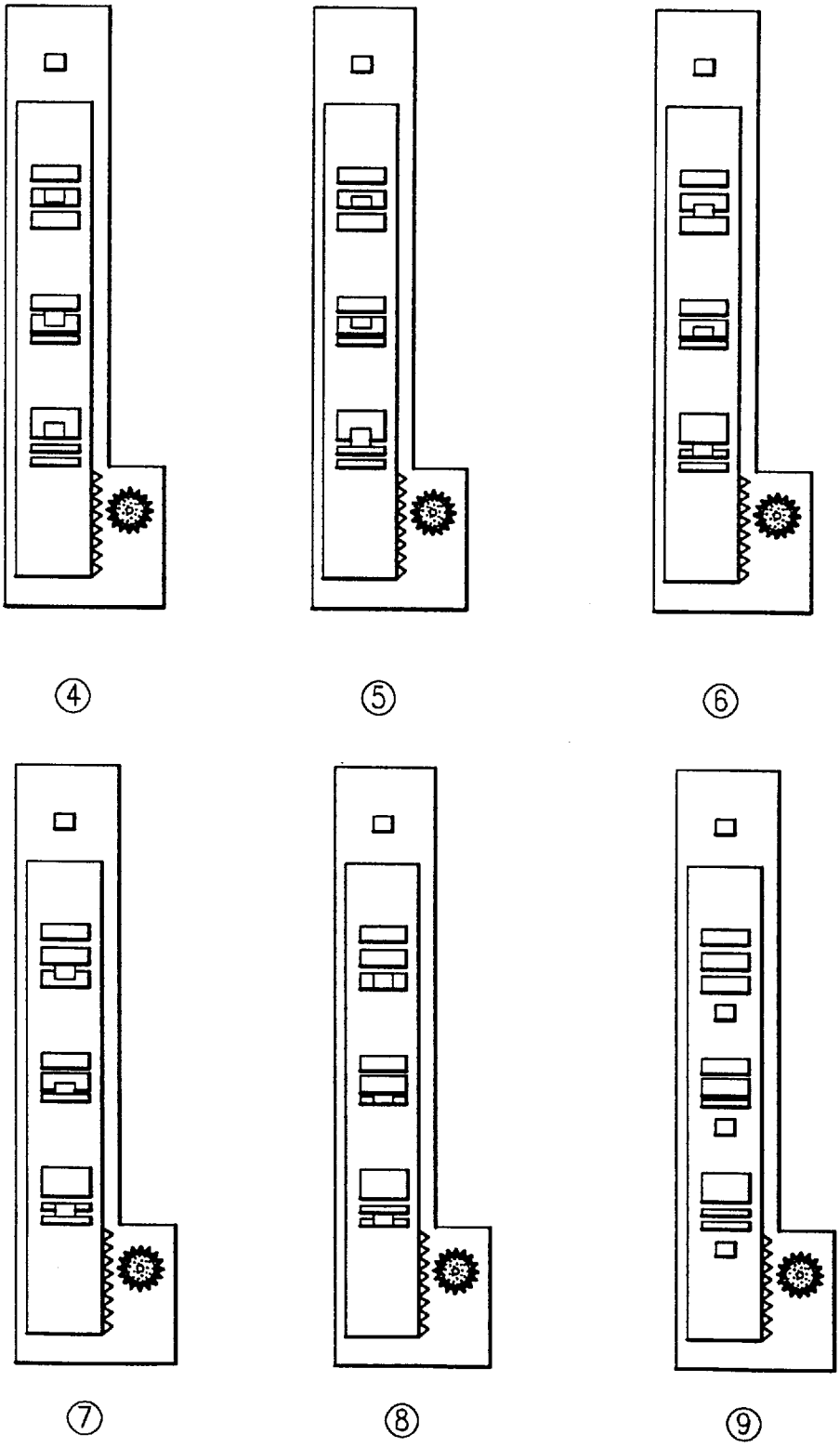
Figure 10A:
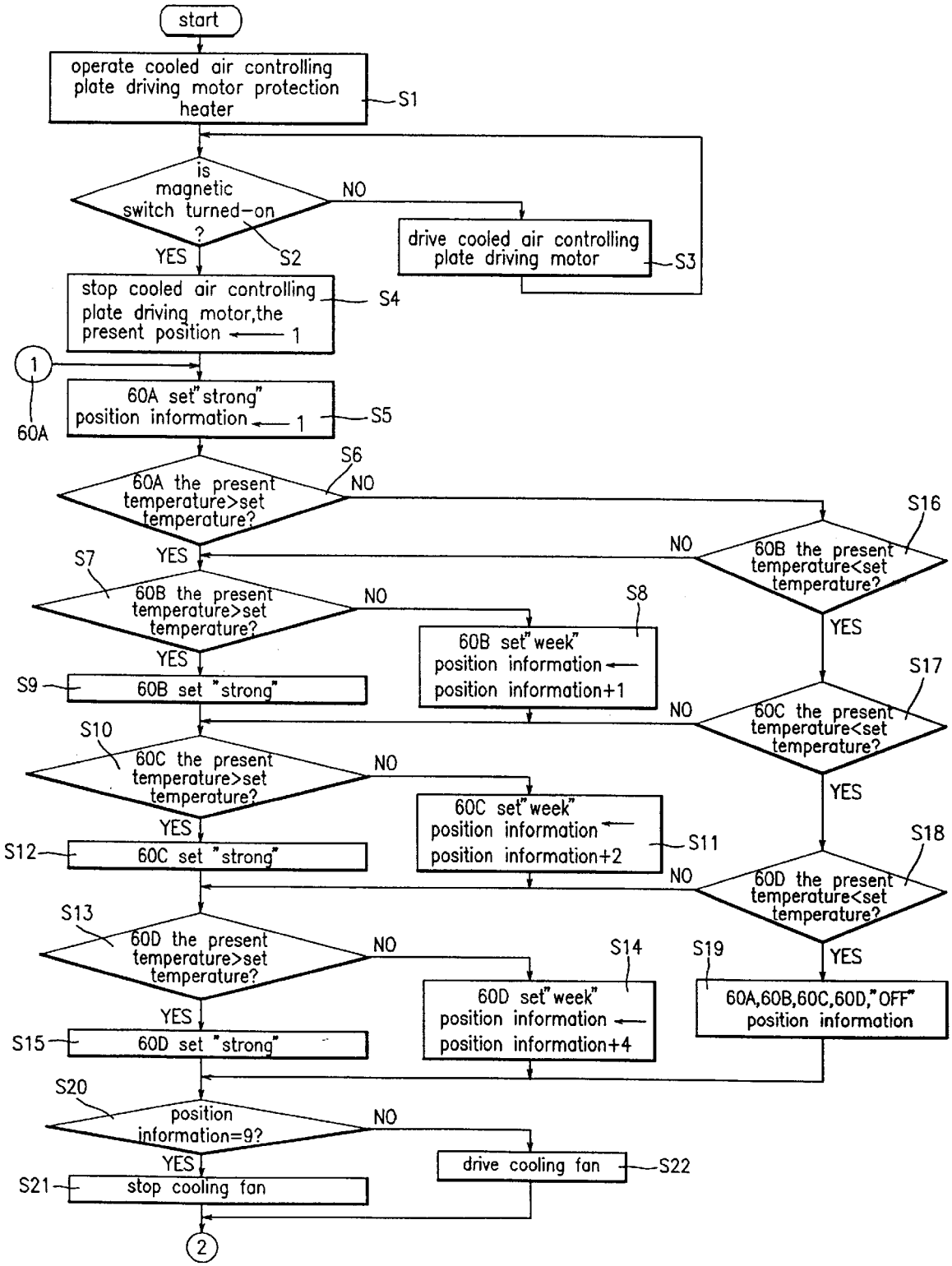
FIG. 10A and FIG. 10B illustrate a flow chart showing an algorithm for controlling individual temperatures of the spaces between shelves in the refrigeration chamber.
Figure 10B:
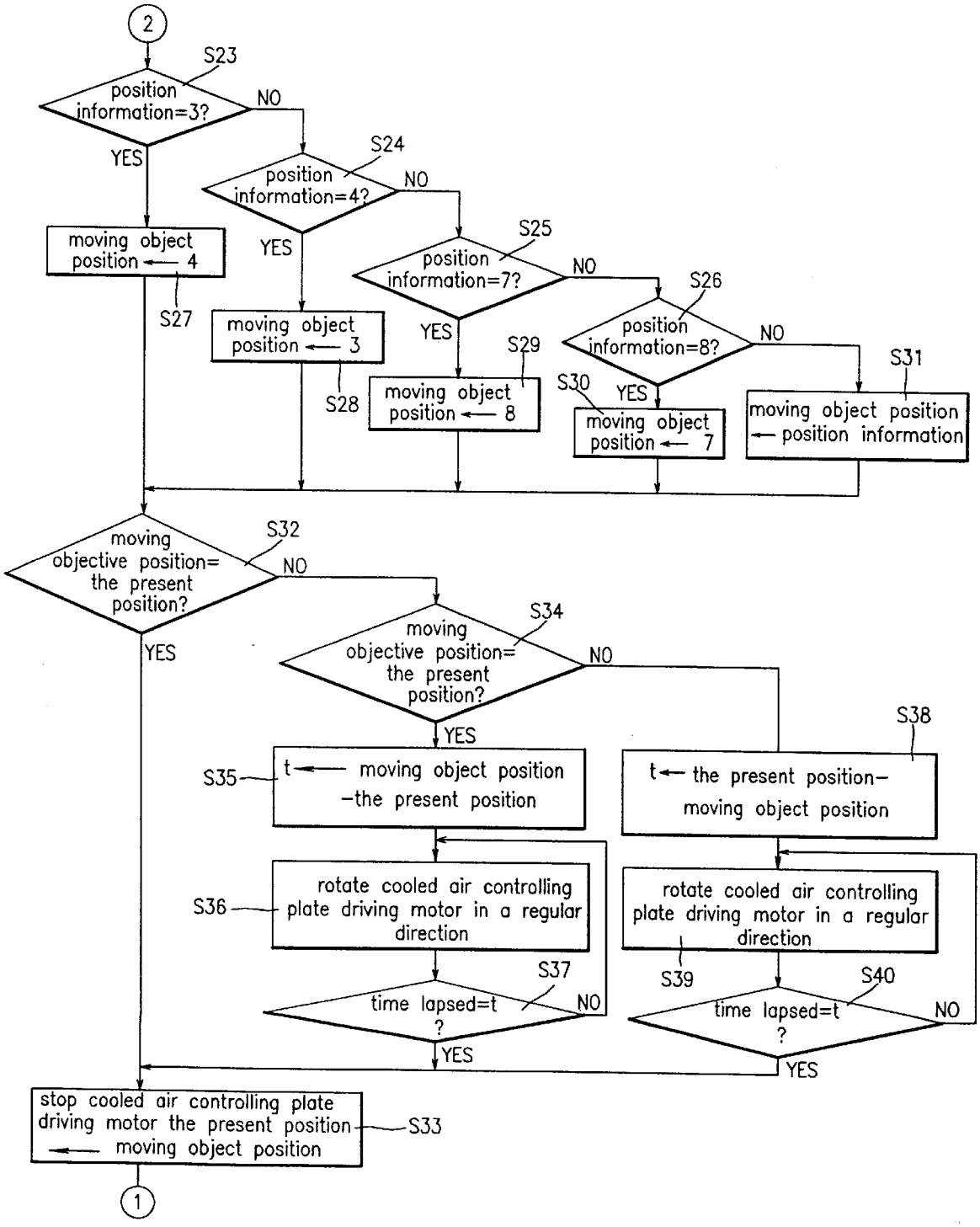

FIG. 4 illustrates a system for controlling the temperature of a refrigerating chamber in a refrigerator in accordance with a first embodiment of the present invention; FIG. 5 shows an arrangement of cooled air discharge outlet controlling openings for spaces between the shelves in a refrigerating chamber of the system shown in FIG. 4; FIG. 6 illustrates an arrangement of cooled air controlling plates of the system shown in FIG. 4; FIG. 7 illustrates a circuit for detecting the position of the cooled air controlling plate shown in FIG. 6; FIG. 8 illustrates a circuit diagram showing the cooled air controlling plate motor driving part and motor protection heater operating part in the system shown in FIG. 4; FIGS. 9A and 9B illustrate an example of multiple stage cooled air discharge rate control system corresponding to the individual temperatures of the spaces between the shelves in the refrigerating chamber of the system shown in FIG. 4; and FIGS. 10A and 10B illustrate a flow chart showing an algorithm for controlling individual temperatures of the spaces between shelves in the refrigerating chamber.

Referring to FIG. 4, the device for controlling the temperature of the refrigerating chamber in a refrigerator of the first embodiment includes a freezing chamber temperature sensing part 21 for sensing the temperature of the freezing chamber, a refrigerating chamber individual space temperature sensing part 22 for sensing temperatures of the individual spaces between shelves in the refrigerating chamber, a user input part 23 for allowing a user to select and set functions of the refrigerator, a cooled air controlling plate position sensing part 24 for sensing the position of the cooled air controlling plate 36 which controls the sizes of the cooled air discharge outlets in multiple stages for controlling the discharge rate of the cooled air discharged to each of the spaces of the refrigerating chamber, an analog-to-digital converting part 25 for converting the analog temperatures from the freezing chamber temperature sensing part 21 and the refrigerating chamber individual space temperature sensing part 22, an input interface part 26 for receiving a user order from the user input part 23 and converting the user order into a particular signal, a central processing part 27 for receiving signals from different parts and controlling different parts for controlling the temperature in the refrigerating chamber, a calculating part 28 for carrying out the calculating function required by the central processing part 27, a memory part 29 for storing signals received at the central processing part 27 and the data related to calculation, an output interface part 40 for applying driving signals to different driving parts of the refrigerator and presenting display signals under the control of the central processing part 27, a display part 31 for receiving the display signals from the output interface part 40 for displaying the operating conditions of the refrigerator to the user, a compressor driving part 32 for receiving a driving signal from the output interface part 40 for driving a compressor for compressing the refrigerant, a cooling fan driving part 33 for receiving the driving signal from the output interface part 40 for driving the cooling fan for blowing out cooled air; a cooled air controlling plate motor driving part 34 for receiving driving signals from the output interface part 40 for controlling the sizes of the cooled air discharge outlets in multiple stages for controlling a discharge rate of the cooled air into each of the spaces according to temperature in each of the spaces of the refrigerating chamber, and a cooled air controlling plate driving motor protection heater operating part 35 for receiving a driving signal from the output interface part 40 for preventing excessive cooling of the cooled air controlling plate driving motor.

In particular, a microcomputer 100, inclusive of the interface part 26, the central processing part 27, the calculating part 28, the memory part 29, and the output interface part 40, receives signals corresponding to individual temperatures sensed at the refrigerating chamber individual space temperature sensing part 22 and drives the compressor driving part 32, the cooling fan driving part 33, and the cooled air controlling plate motor driving part 34, for controlling the cooled air controlling plate 36 to supply cooled air to the spaces in an amount and rate different from one another.

Referring to FIGS. 5 and 6, the cooled air controlling plate, serving the function of the conventional damper as well as the controlling function of the present invention, includes cooled air discharge outlet controlling openings 36A for partial or total closing or opening of each of the cooled air discharge outlets to each of the spaces between the shelves in the refrigerating chamber for controlling the discharge rate of cooled air discharged into each of the spaces in multiple stages, and a cooled air controlling plate rack 36B disposed at one side of the cooled air controlling plate 36 for moving the plate 36 in an up and down direction for controlling the cooled air discharge outlet controlling openings 36A. The cooled air discharge outlet controlling openings 36A have a plurality of different sized controlling openings spaced at predetermined intervals.

The cooled air controlling plate motor driving part 34 includes a cooled air controlling plate driving motor pinion 34A for moving the cooled air controlling plate 36 in the up and down direction, a cooled air controlling plate driving motor 34B for driving the cooled air controlling plate driving motor pinion 34A, and a cooled air controlling plate driving motor protection heater 34C for protection against excessive cooling of the cooled air controlling plate driving motor. The cooled air controlling plate driving motor protection heater operation part 35 has a relay RY for operating the cooled air controlling plate driving motor protection heater 34C under the control of the microcomputer 100, which circuit is as shown in FIG. 8.

Referring to FIG. 7, the cooled air controlling plate position sensing part 24 includes a magnetic sensor 36D disposed at one side of the cooled air controlling plate 36 for generating a signal indicating a movement of the cooled air controlling plate 36, and a sensing switching part 36C for sensing the signal from the magnetic sensor 36D.

The operation and advantages of the device for controlling the temperature in the refrigerating chamber of the refrigerator of the present invention will now be explained.

When the user sets the temperatures of the freezing and refrigerating chambers 50 and 60 which are divided into spaces by partition members, such as shelves, the interface part 26 transfers the set temperatures to the central processing part 27. The central processing part 27, on receiving the set temperatures, stores the temperatures in the memory part 29 and drives the compressor driving part 31 through the output interface part 40 for compressing the refrigerant, thereby cooling down the air in the freezing chamber 50.

Upon receiving the temperature in the freezing chamber 50 from the freezing chamber temperature sensing part 21 through the analog-to-digital converting part 25, the central processing part 27 compares the received temperature to the user-set freezing chamber temperature stored in the memory part 29 to drive the compressor driving part 31 until the user-set freezing chamber temperature is reached. The central processing part 27 controls the cooling fan driving part 33 and the cooled air controlling plate motor driving part 34 to let the cooled air flow into the refrigerating chamber 60.

Referring to FIGS. 5 and 6, the refrigerating chamber includes a cooled air passage 70 for leading the cooled air in the freezing chamber 50 to the refrigerating chamber, same size cooled air discharge outlets 80 for discharging the cooled air into the spaces between the shelves in the refrigerating chamber, cooled air discharge outlet controlling openings 36A for partial or total closing or opening of the cooled air discharge outlets 80A~80D for controlling the discharge rate of the cooled air discharged into each of the spaces in multiple stages, a cooled air controlling plate 36 having a cooled air controlling plate rack 36B for moving the controlling plate 36 in an up and down direction for controlling the sizes of the cooled air discharge outlet controlling openings 36A, a cooled air controlling plate driving motor 34B having a cooled air controlling plate driving motor pinion 34A for moving the cooled air controlling plate 36 in an up and down direction for controlling the opening area of each of the cooled air discharge outlets, and a cooled air controlling plate position sensing switch 36C and a permanent magnet 36D for sensing the position of the cooled air controlling plate 36.

As the cooling fan driving part 33 is operated, the cooling fan is rotated to supply the cooled air into each of the spaces in the refrigerating chamber 60 through the cooled air discharge outlets 80A~80D in the cooled air passage 70, thereby cooling down the refrigerating chamber.

Upon receiving individual temperatures in each of the spaces of the refrigerating chamber from the refrigerating chamber individual space temperature sensing part 22, the central processing part 27, when finding any of the individual temperatures are different from the user-set temperature, applies driving signals to the cooled air controlling plate motor driving part 34 and the cooled air controlling plate driving motor protection heater driving part 35 through the output interface part 40. The cooled air controlling plate motor driving part 34 then moves the cooled air controlling plate 36 in an up and down direction to control the discharge rate of cooled air discharged to each of the spaces of the refrigerating chamber in multiple stages.

The manner of controlling the refrigeration in multiple stages is as follows.

Upon driving the cooled air controlling plate driving motor 34B, the cooled air controlling plate rack 36B engages with the cooled air controlling plate driving motor pinion 34A to move the cooled air controlling plate 36 in an up and down direction, and as the cooled air controlling plate moves in the up and down direction, the cooled air discharge outlet controlling openings 36A and the cooled air discharge outlets 80A~80D overlap and open to each of the spaces of the refrigerating chamber to adjust the net areas of the openings, opened to the refrigerating spaces, thereby controlling the discharge rate of the cooled air discharged to each of the spaces of the refrigerating chamber in multiple stages, and thereby controlling the temperatures in the individual spaces.

The sensing of the position of the cooled air controlling plate 36 in controlling the individual temperatures of the spaces in the refrigerating chamber by moving the cooled air controlling plate in the up and down direction, which uses the cooled air controlling plate position sensing switch 36*c*, is carried out as follows.

Referring to FIG. 6, a permanent magnet 36D is attached to a lower part of the cooled air controlling plate 36, and the cooled air controlling plate position sensing switch 36C is attached to the side of the cooled air passage 70 opposite to the permanent magnet 36D. In this situation, the position sensing is done by the circuit shown in FIG. 7, the operation of which will be explained below. The cooled air controlling plate position sensing switch is magnetic.

For example, when the cooled air controlling plate 36, which is driven by the cooled air controlling plate motor driving part 34, is not positioned at its lowest position, the magnetic switch 36C is open because the magnetic force of the permanent magnet 36D cannot influence the switch 36C. Therefore, a high voltage from the power source Vcc is applied to an input terminal P1 of the input interface part 26 through a resistor R1 and a condenser C1. The central processing part 27, when receiving this high voltage through the input interface part 26, recognizes that the cooled air controlling plate 36 is not positioned at its lowest part.

When the cooled air controlling plate is positioned at its lowest part, as the magnetic switch 36C is closed by the magnetic force of the permanent magnet 36D, for the high voltage from the power source Vcc to by-pass toward ground, a low voltage is applied to the input terminal P1 of the input interface part 26. Accordingly, central processing part 27, upon receiving the low voltage through the interface part 26, recognizes that the cooled air controlling plate 36 is positioned at its lowest part.

Upon sensing the position of the cooled air controlling plate 36 through the aforementioned position sensing process, the central processing part 27 controls the cooled air controlling plate 36 to move in the up and down direction to control the sizes of the cooled air discharge outlets 36A, thereby controlling the individual temperatures of the spaces of the refrigerating chamber.

The operations of the cooled air controlling plate motor driving part 34 and the cooled air controlling plate driving motor protection heater operation part 35 will be explained with reference to FIG. 8.

When the output interface part 40 outputs a high signal for a regular direction rotation of the cooled air controlling plate driving motor through an output terminal P3, and a high signal for a reverse direction rotation of the cooled air controlling plate driving motor through an output terminal P2 at the same time and under the control of the central processing part 27, as NAND gate ND1 in the cooled air controlling plate motor driving part 34 conducts an NAND operation of the two signals to produce a low signal. According to this low signal, as AND gates AD1 and AD2 produce low signals which drive the cooled air controlling plate driving motor, the driving of the cooled air controlling plate driving motor is prevented.

When the output interface part 40 outputs a high signal for a regular direction rotation of the cooled air controlling plate driving motor through the output terminal P3 thereof and outputs a low signal for a reverse direction rotation of the cooled air controlling plate driving motor through the output terminal P2 thereof, as the signal from the NAND gate ND1 becomes "high" and the signal from the AND gate AD1 becomes "low" to turn off the reverse direction rotation transistors Q2 and Q3 and as a signal from the AND gate AD2 becomes "high" to turn on regular the regular direction rotation transistors Q1 and Q4, the cooled air controlling plate driving motor 34B is rotated in the regular direction.

When the output interface part 40 outputs a high signal for the reverse direction rotation of the cooled air controlling plate driving motor through the output terminal P2 thereof and a low signal for the regular direction rotation stopping of the cooled air controlling plate driving motor through an output terminal P3 thereof, as the signal from the NAND gate ND1 becomes "high" and the signal from the AND gate AD2 becomes "low" to turn off the regular direction rotation transistors Q1 and Q4 and as the signal from the AND gate AD1 becomes "high" to turn on the reverse direction rotation transistors Q2 and Q3, the cooled air controlling plate driving motor 34B is rotated in the reverse direction. The circuit in combination with the AND gates AD1 and AD2 and the NAND gate ND is a cooled, air controlling plate motor protection circuit. By thus driving the cooled air controlling plate driving motor 34 in a regular or reverse direction, the cooled air controlling plate 36 can be moved in an up and down direction.

When the output interface part 40 outputs a low signal for operating the cooled air controlling plate driving motor protection heater through an output terminal P4 thereof, a relay RY in the cooled air controlling plate driving motor protection heater operation part 35 is closed for applying power to heater H. The heat of the heater H prevents the cooled air controlling plate driving motor 34B from freezing. Thus, individual temperatures in the spaces of the refrigerating chamber can be controlled.

The aforementioned operation will be explained with reference to the flow chart of FIGS. 10A and 10B.

Power is applied to the cooled air controlling plate driving motor protection heater H to operate the heater H for preventing the cooled air controlling plate driving motor 34B from freezing (S1). The cooled air controlling plate driving motor 34B is driven (S3) until the magnetic switch 36C is closed (S2) for positioning the cooled air controlling plate 36 at the lowest part, which is the initial position of the plate 36. The cooled air controlling plate 36 is positioned at the lowest position, which is set to be 1 (S4).

At this time, the user may preset the individual temperatures in the spaces of the refrigerating chamber, as necessary.

Then the supply rate of cooled air to the first shelf 60A is set to "strong," and the position information of this case is set to 1 (S5).

The present temperature in the first shelf 60A is determined to be higher than the preset temperature (S6). If the present temperature is found to be higher than the preset temperature, the present temperature in a second shelf 60B is compared as being higher than the preset temperature (S7). If the present temperature is found to be lower than the preset temperature by comparison, the supply rate to the second shelf 60B is set to "weak" and the position information of this time is set to be above the position information plus one (S9). Then the present temperature in a third shelf 60C is compared as being higher than the preset temperature (S10). If the present temperature is found to be lower than the preset temperature in the comparison, the supply rate to the third shelf 60C is set to "weak" and the position information at this time is set to be the position information set in the case of the second shelf 60B temperature comparison plus two (S11). And, if the present temperature is found to be higher than the preset temperature in the comparison, the supply rate to the third shelf 60C is set to "strong" (S12). Then, the present temperature in a third shelf 60C is compared as being higher than the preset temperature (S10). If the present temperature is found to be lower than the preset temperature in the comparison, the supply rate to the third shelf 60C is set to "weak" and the position information of this time is set to be the position information set in the case of the second shelf 60B temperature comparison plus two (S11). And, if the present temperature is found to be higher than the preset temperature in the comparison, the supply rate to the third shelf 60C is set to "strong" (S12). Then, the present temperature in a third shelf 60C is compared as being higher than the preset temperature (S10). If the present temperature is found to be lower than the preset temperature in the comparison, the supply rate to the third shelf 60C is set to "weak" and the position information of this time is set to be the position information set in the case of the second shelf 60B temperature comparison plus two (S11). And, if the present temperature is found to be higher than the preset temperature in the comparison, the supply rate to the third shelf 60C is set to "strong" (S12). Then, the present temperature in a fourth shelf 60D is compared as being higher than the preset temperature (S13). If the present temperature is found to be lower than the preset temperature in the comparison, the supply rate to the fourth shelf 60D is set to "weak" and the position information of this time is set to be the position information set in the case of the third shelf 60C temperature comparison plus four (S14). And, if the present temperature is found to be higher than the preset temperature in the comparison, the supply rate to the fourth shelf 60D is set to "strong" (S15).

On the other hand, if the present temperature in the first shelf 60A is found to be lower than the preset temperature, the present temperature in the second shelf 60B is determined as being lower than the preset temperature (S16). If the present temperature in the second shelf 60B is found to be higher than the preset temperature, the process proceeds to the step of comparing the temperature in the second shelf 60B, and if the present temperature in the second shelf 60B is found to be lower than the preset temperature, the process proceeds to the step of comparing the temperature in the third shelf 60C (S17). If the present temperature in the third shelf 60C is found to be higher than the preset temperature, the process proceeds to the step of comparing the temperature in the third shelf 60C, and if the present temperature in the third shelf 60C is found lower than the preset temperature, the process proceeds to the step of comparing the temperature in the fourth shelf 60D (S18). If the present temperature in the fourth shelf 60D is found to be higher than the preset temperature, the process proceeds to the step of comparing the temperature in the fourth shelf 60D, and if the present temperature in the fourth shelf 60D is found to be lower than the preset temperature, the position information of this case is set to 9 (S19) in order not to supply cooled air to any of the shelves.

Referring to FIGS. 9A and 9B, the position information 1 to 9 is multiple stage position information of the cooled air controlling plate 36 on moving the cooled air controlling plate 36 in multiple stages for controlling the supply rate of cooled air to each of the spaces between shelves in the refrigerating chamber as "strong," "weak" and "cut off."

The position information up to now is determined as being 9 (S20). If the position information is found to be 9, the cooling fan is stopped (S21), and if not, the cooling fan is driven continuously (S22).

Thereafter, the position information obtained in the aforementioned process is compared when being 3, 4, 7, or 8 (S23, S24, S25, and S26). If the position information is 3, a moving position is set taking the position information as 4 (S27); if the position information is 4, a moving position is set taking the position information as 3 (S28); if the position information is 7, a moving position is set taking the position information as 8 (S29); and if the position information is 8, a moving position is set taking the position information as 7 (S30). If the position information obtained in the aforementioned process does not fall in any of the above position information of 3, 4, 7, and 8, a moving position is set taking the position information set in the aforementioned temperature comparison (S31).

Then, the moving position is determined as being the present position (S32). If the moving position is found identical to the present position, the cooled air controlling plate driving motor is stopped, and the moving position is set to the present position (S33). If the moving position is found not to be identical to the present position, the moving position is compared as being greater than the present position (S34). If the moving position is found to be greater than the present position, the present position is subtracted from the moving position, the value of the position of the cooled air controlling plate 36 is stored (S35), and the cooled air controlling plate driving motor is activated to rotate in a regular direction (S36) and the motor is operated continuously until the value is reached (S37). If the moving position is found not to be greater than the present position, the present position is subtracted from the moving position, the value of the position of the cooled air controlling plate 36 is stored (S38), the cooled air controlling plate driving motor is activated to rotate in a reverse direction (S39) and the motor is operated continuously until the value is reached (S40) By thus supplying cooled air for cooling down individual temperatures in the spaces of the refrigerating chamber, the temperature in the refrigerating chamber can be controlled.

Then, the cooled air controlling plate driving motor is stopped, the moved position is set to the present position (S33), and the process proceeds back to S5, whereby the process is repeated for controlling the temperatures to the preset temperature.

The aforementioned first embodiment of the present invention may be summarized as follows.

The extent of cooling of the refrigerating chamber is set according to the individual temperatures in the spaces of the refrigeration chamber, and the value of the position information at which the cooled air controlling plate should be positioned and the value of the already set position information are re-calculated according to this set extent of cooling to set new position information. According to this newly set position information, the cooling fan 33A is driven and stopped. In order to set a position to which the cooled air controlling plate is to be moved, taking the newly set position information and to move the cooled air controlling plate 36 to the set position, the objective position and the present position are compared and the cooled air controlling plate driving motor 34B is rotated in a regular or reverse direction, whereby the cooled air controlling plate 36 is moved. After moving the cooled air controlling plate 36 to the objective position, the moved position is again set as the present position.

By repeating the aforementioned operation, individual temperatures in the spaces of the refrigerating chamber 60 can be controlled.

Second Embodiment

Figure 11:
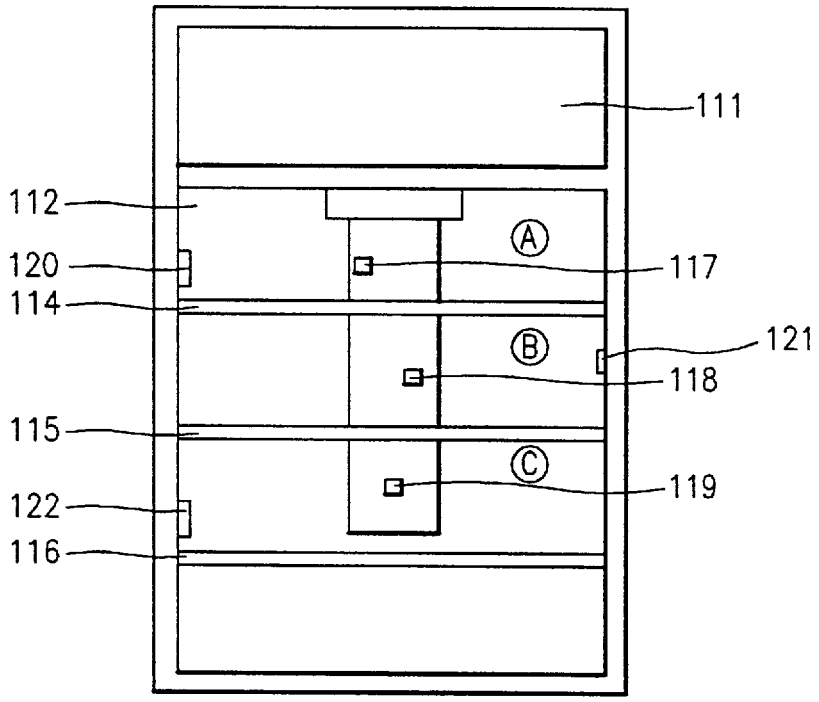
FIG. 11 illustrates a cooled air distribution device for controlling the temperature in a refrigerating chamber in accordance with a second embodiment of the present invention.
Figure 12:
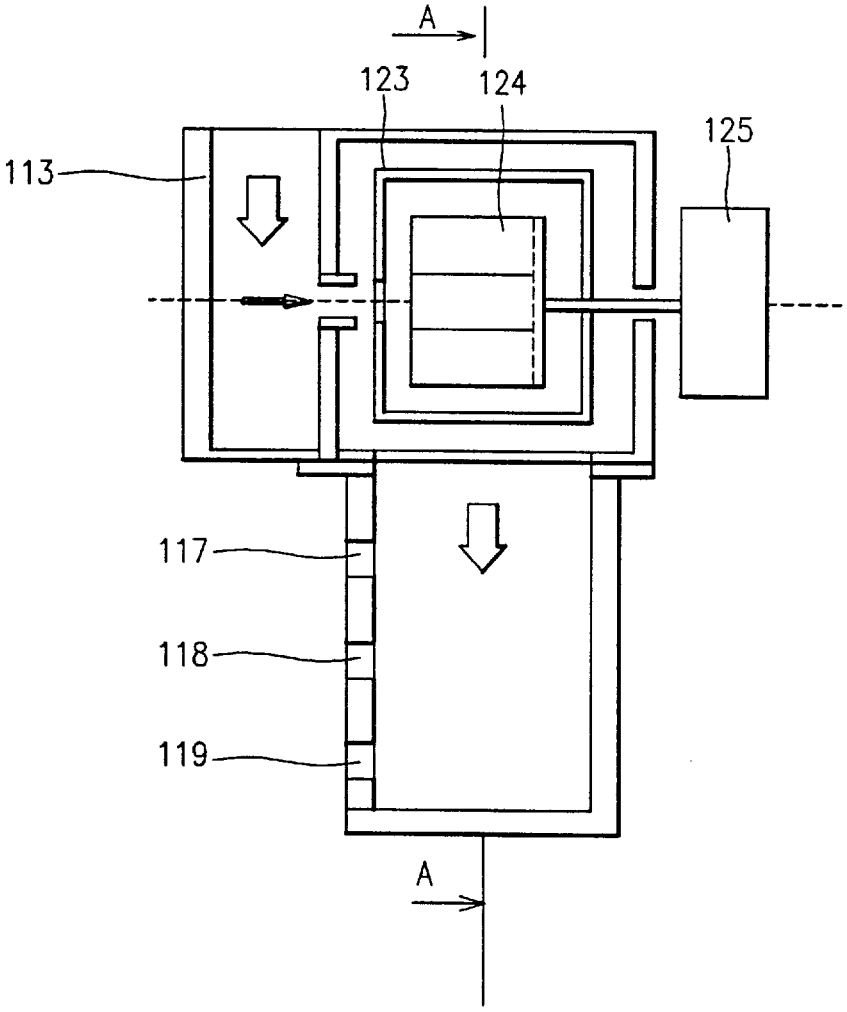
FIG. 12 illustrates a longitudinal cross section of the cooled air distribution device for controlling the temperature in the refrigerating chamber of FIG. 11.
Figure 13:
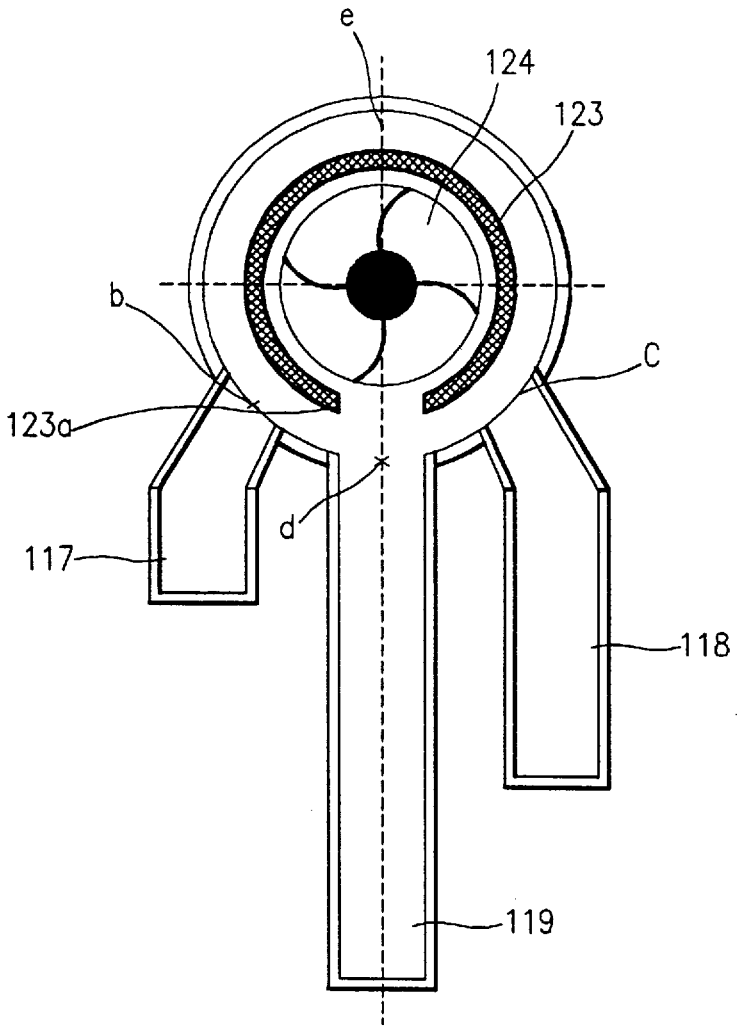
FIG. 13 illustrates a section taken along line A—A of FIG. 12.
Figure 14:
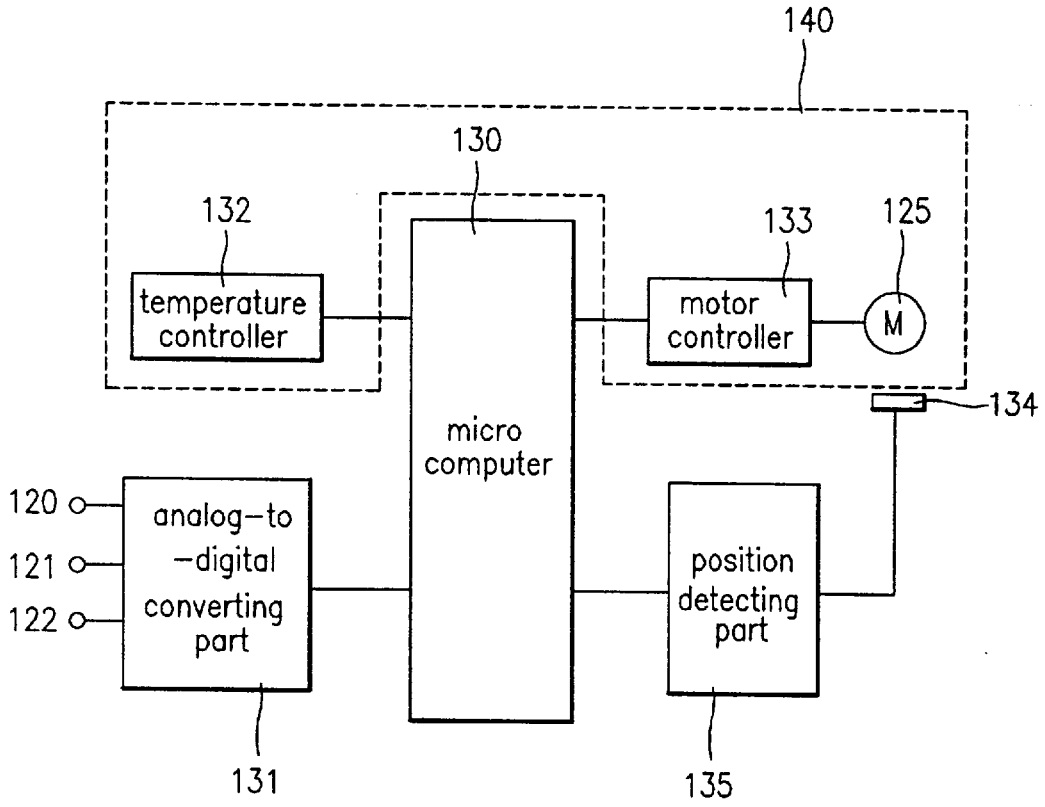
FIG. 14 illustrates the electrical circuit of the cooled air distribution device for controlling the temperature in the refrigerating chamber of FIG. 11.
Figure 16:
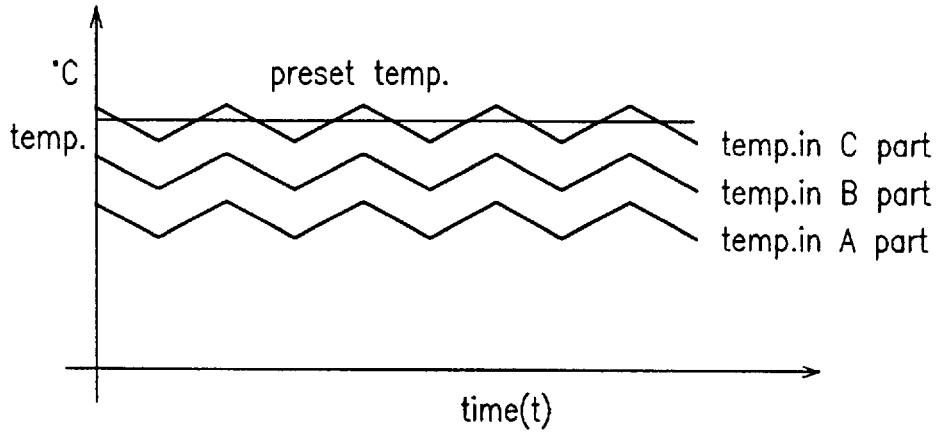
FIG. 16 illustrates a graph showing the temperature distribution of the refrigerating chamber of a conventional refrigerator case.
Figure 17:
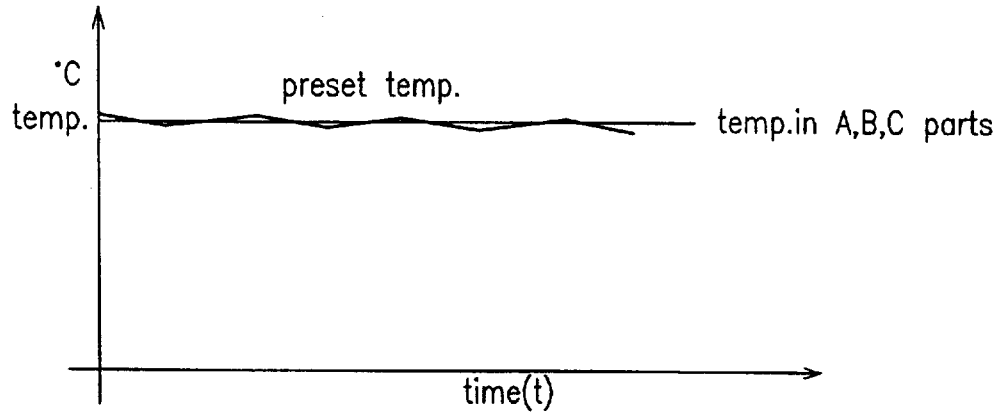
FIG. 17 illustrates a graph showing the temperature distribution of the refrigerating chamber of a refrigerator case of the present invention.
Figure 18:
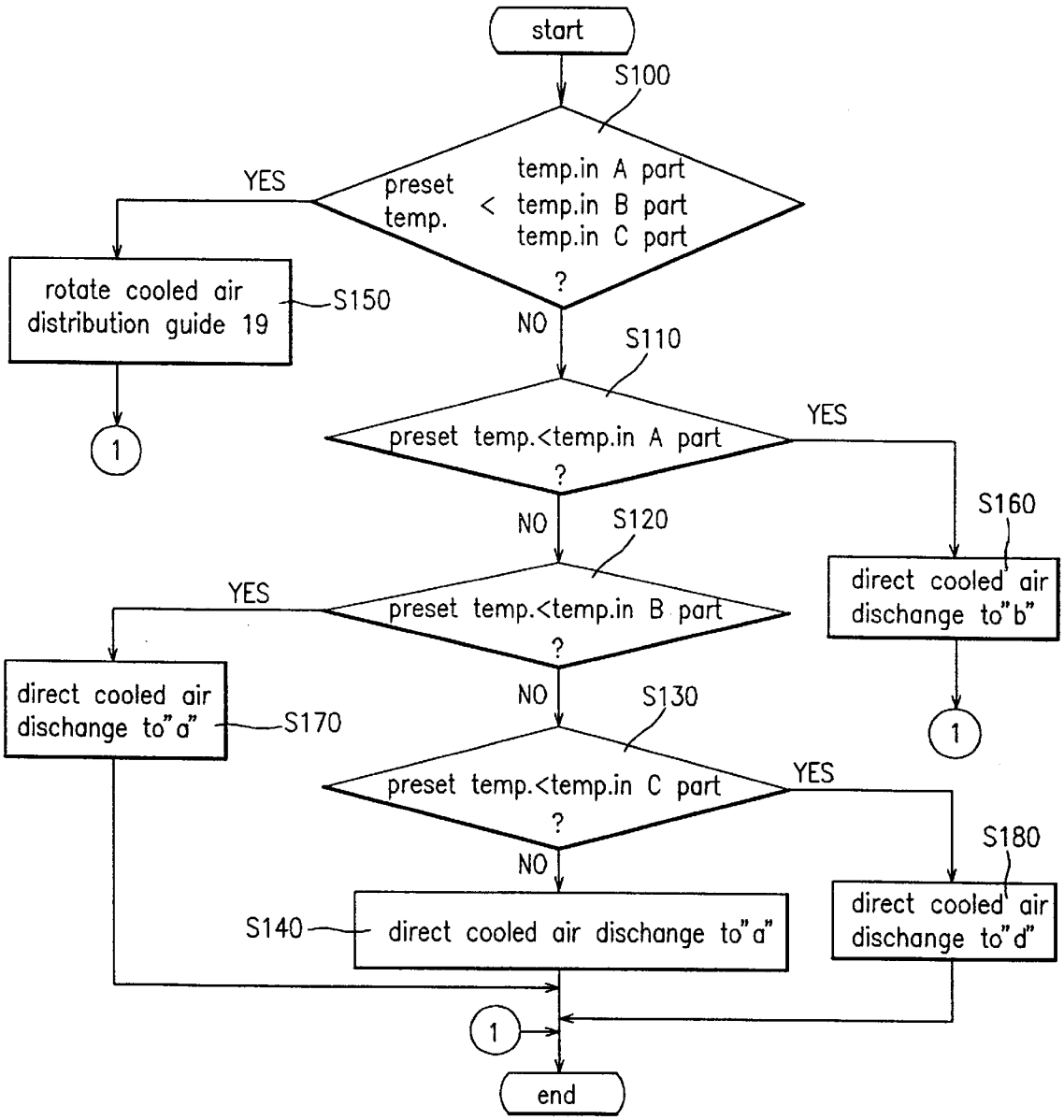
FIG. 18 illustrates a flow chart showing the steps of the method for controlling the temperature of a refrigerating chamber in a refrigerator in accordance with the present invention.

FIG. 11 illustrates a cooled air distribution device for controlling the temperature in a refrigerating chamber in accordance with a second embodiment of the present invention; FIG. 12 illustrates a longitudinal cross section of the cooled air distribution device for controlling the temperature in the refrigerating chamber of FIG. 11; FIG. 13 illustrates a section taken across line A—A of FIG. 12; FIG. 14 illustrates the circuit of the cooled air distribution device for controlling the temperature in the refrigerating chamber of FIG. 11; FIG. 15 illustrates various states of a cooled air distributing guide in the cooled air distribution device for controlling the temperature in the refrigerating chamber of FIG. 11; FIG. 16 illustrates a graph showing the temperature distribution of a refrigerating chamber of a conventional refrigerator case; FIG. 17 illustrates a graph showing the temperature distribution of the refrigerating chamber of the refrigerator case of the present invention; and FIG. 18 illustrates a flow chart showing the steps of a method for controlling a temperature of a refrigerating chamber in a refrigerator, in accordance with the present invention.

Referring to FIGS. 11 and 12, a device for controlling the temperature in a refrigerating chamber of a refrigerator, in accordance with the second embodiment of the present invention, includes temperature sensors 120, 121, and 122 each disposed in one of the compartments between the shelves 114, 115, and 116 on walls of the refrigerating chamber in diagonally opposite positions relative to one another for sensing the temperature in each of the compartments, individually. The cooled air discharge outlets 117, 118, and 119 are each disposed in one of the compartments between the shelves 114, 115, and 116 for discharging the cooled air flowing from a freezing chamber 111 through the cooled air passage 113 into the refrigerating chamber 112.

Referring to FIG. 13, the cooled air passage 113 has, as means for distributing the cooled air to the cooled air discharge outlets 117, 118, and 119, a cooled air guide 123 for selectively guiding the cooled air to each of the cooled air paths of the cooled air discharge outlets. The cooled air distribution guide 123 is provided with a cooling fan and a motor for rotating both the cooling fan 124 and the cooling air distribution guide 123. The cooled air distribution guide 123 has a cooled air guide opening 123*a* for guiding the cooled air.

Referring to FIG. 14, means for controlling distribution of the cooled air flowing into the refrigerating chamber is provided, including a microcomputer 130, an analog/digital convertor 131 connected to the temperature sensors 120, 121, and 122 in each of the compartments in the refrigerating chamber for transferring the temperatures sensed by the temperature sensors to the microcomputer 130, a refrigerating chamber temperature controller 132 for comparing the sensed temperatures from the analog/digital convertor 131 to the preset refrigerating chamber temperature, a motor controller 133 for controlling the motor 125 according to the difference in the preset temperature from one of the sensed temperatures compared by the microcomputer 130, a motor 125 for rotating the cooled air distribution guide 123 under the control of the motor controller 133, an encoder 134 for detecting the rotation of the motor 125, and a position detector 135 for applying the position of the motor 125 detected by the encoder 134 to the microcomputer 130. The temperature controller 132, the motor controller 133, and the motor 125 are included in a cooled air controlling part 140, which detects individual temperatures in the compartments of the refrigerating chamber and supplies cooled air to each of the compartments with rates which are different from one another.

The operation and control method of the aforementioned device in accordance with the second embodiment of the present invention will be explained.

Each of the values of the temperatures sensed by the temperature sensors 120, 121, and 122 provided in the compartments is applied to the analog/digital converter 131. The analog/digital converter 131 receives and converts the value into a digital value and applies it to the microcomputer 130. The microcomputer 130 compares the value with the temperature set in the refrigerating chamber temperature controller 132 to drive the motor 125 in case the value is lower then the set value. At this time, the encoder 134 detects the position of the motor and applies it to the position detector 135 which detects the present position of the motor and applies it to the microcomputer 130. Upon receiving the present position from the position detector 135, the microcomputer 130 determines the direction of the cooled air discharged from the cooled air distribution guide 123 to the refrigerating chamber.

The step to determine the direction of the cooled air discharge is done by controlling the motor which rotates the fan 124 and the cooled air distribution guide 123 for changing the direction of the cooled air discharge opening at one side of the cooled air distribution guide 123.

For example, referring to FIG. 15, when each of the temperatures from the temperature sensors 120, 121, and 122 attached in the refrigerating chamber is compared to a preset temperature, the microcomputer 130 takes the case as unity when each of the temperatures from the temperature sensors 120, 121, and 122 is higher than the preset temperature, and takes the case as naught when lower than the preset temperature. If the taken values from the first temperature sensor 120, the second temperature sensor 121 and the third temperature sensor 122 from the top of the refrigerating chamber are 0, 0, 0, respectively, since it indicates that all the temperatures in all the compartments of the refrigerating chamber are low, the microcomputer 130 controls the cooled air distribution part 140 to move the cooled air distribution guide to the "e" position to reduce the supply rate of cold air to some extent.

If the taken values from the first temperature sensor 120, the second temperature sensor 121, and the third temperature sensor 122 from the top of the refrigerating chamber are 0, 0, 1, respectively, understanding that the temperature in the third compartment of the refrigerating chamber is high, the microcomputer 130 controls the cooled air distribution part 140 to move the cooled air distribution guide to the "d" position to intensively supply cooled air to the third compartment.

Thus, by changing the position of the cooled air distribution guide 123 according to the individual temperatures of the refrigerating chamber, the supply rate of the cooled air corresponding to the individual temperatures of the compartments can be individually or intensively supplied, or cut off, or reduced.

Referring to FIG. 16, the temperature distribution by the conventional temperature controlling device for a refrigerating chamber of a refrigerator shows that the temperature in the first compartment at the top of the refrigeration chamber is the lowest, and that the temperatures rise in the lower portion of the refrigeration chamber, showing non-uniform cooling in the chamber. However, referring to FIG. 17, it can be seen that the temperature distribution utilizing the temperature controlling device in accordance with the present invention shows a uniform cooling to the user preset temperature in all the spaces of the refrigerating chamber.

The aforementioned method for controlling the direction of the cooled air discharge will be explained with reference to FIG. 18.

In the case where the temperature in the "A" compartment is higher than the preset temperature (S100 and S110), the position of the cooled air guide opening 123*a* in the cooled air distribution guide 123 is moved to the "c" or "d" point, for the cooled air to flow only to the cooled air discharge outlet 117 to cool down the temperature in the "B" or "C" compartments (S170 and S180).

However, if all the temperatures in the "A," "B," and "C" compartments are higher than the preset temperature, the cooled air distribution guide 123 is continually rotated to evenly supply cooled air throughout the refrigerating chamber (S150).

Contrary to the above, if all of the temperatures in the "A," "B," and "C" compartments are lower than the preset temperature, the direction of discharge of the cooled air guide opening 123*a* is directed to the "e" point, to cut off cooled air flow to the refrigerating chamber (S140).

The "A," "B," and "C" compartments are compartments of the refrigerating chamber in order from the top to the bottom.

Thus, the entire temperature in the refrigerating chamber can be maintained constant and uniform to a preset temperature.

As has been explained, the device for controlling the temperature in the refrigerating chamber of a refrigeration of the present invention can supply cooled air from the freezing chamber to the refrigerating chamber quickly, in the case where the temperature in the refrigerating chamber is high, by driving the fan and the cooled air distribution guide connected to the motor. In the case where the temperature in a certain compartment of the refrigerating chamber rises due to new food being put into the compartment, the cooled air is intensively supplied into the compartment by using the cooled air distribution guide for maintaining the temperature in the refrigerating chamber always uniform.

Accordingly, the device of the present invention can maintain all the individual temperatures in the compartments of the refrigerating chamber substantially constant and consistent with a preset temperature as shown in FIGS. 9A and 9B when the cooling load of the chamber is stable, whereby the fresh storage of food in the refrigerating chamber is made possible.

It will be apparent to those skilled in the art that various modifications and variations can be made to the method and apparatus of the present invention without department from the spirit or scope of the invention. Thus, it is intended that the present invention cover the modifications and variations which fall within the scope of the appended claims and their equivalents.

What is claimed is:

1. An apparatus for controlling the temperature in various compartments of a refrigeration chamber of a refrigerator, comprising:

user input means for presetting a desired temperature for each of the compartments being controlled;

temperature sensing means for sensing the actual temperature in each of the compartments being controlled;

temperature determining means for determining a difference between the preset temperature and the actual temperature for each of the compartments being controlled; and cooled air selective means for selectively controlling an amount of cooled air introduced into the compartments being controlled based on the difference between the preset temperature and the actual temperature, the cooled air selective means including a cooled air controlling plate containing a plurality of air discharge outlets which communicate with respective compartments being controlled, the size of the outlets being set in predetermined ratios to control the discharge rates of the cooled air into the compartments being controlled, wherein changes in the actual temperature of the compartments being controlled are monitored and used to control the cooled air selective means.

2. The apparatus of claim 1, including a position sensing means for sensing the size of the outlets in the cooled air controlling plate.

3. The apparatus of claim 2, wherein the position sensing means includes, a magnetic sensor disposed at one side of the cooled air controlling plate for sensing the movement of the cooled air controlling plate, and a sensing switch means is provided for operation in response to a signal of movement from the magnetic sensor.

4. The apparatus of claim 2, further including an analog-to-digital connecting means for digitizing signals received from the temperature sensing means and a microcomputer, responsive to signals from the user input means, the position sensing means and said analog-to-digital connecting element, for controlling the cooled air supply of the entire system.

5. The apparatus of claim 4, wherein the microcomputer includes, an input interface means for interfacing the user input means and the position sensing means, a central processing means responsive to the signal from the analog-to-digital converting means for comparing, determining, and controlling the refrigerating chamber temperature, a calculating means in charge of calculating function under the control of the central processing means, a memory means for storing input/output data of the central processing means and other data, and an output interface means for interfacing control signals of the central processing means.

6. The apparatus of claim 4, wherein said plurality of discharge outlets are differently sized in fixed intervals for controlling the discharge rates of the cooled air.

7. The apparatus of claim 6, wherein a cooled air controlling plate rack is disposed adjacent the cooled air controlling plate for moving the cooled air controlling plate.

8. The apparatus of claim 7, wherein the cooled air controlling plate driving means includes, a driving pinion engaged with the cooled air controlling plate rack for moving the cooled air controlling plate, a driving motor for supplying power to a driving pinion, and a driving element for driving the driving motor under the control of the microcomputer.

9. The apparatus of claim 4, further including, a compressor for supplying cooled air to the refrigeration chamber, a cooling fan for distributing the cooled air to the cooled air controlling plate and means for driving the cooled air controlling plate for changing the size of the air discharge outlets, said compressor, said cooling fan, and said driving means being controlled by said microcomputer.

10. The apparatus of claim 9, wherein protection means are provided for protecting the driving means from being cooled.

11. A device as claimed in claim 10, wherein the cooled air controlling plate driving means is structurally integrated with the protection means.

12. The apparatus recited by claim 1, further comprising an additional compartment in the refrigerator chamber of the refrigerator, the cooling air being directed into the additional compartment without being controlled by the cooled air controlling plate of the cooled air selective means.

13. The apparatus recited by claim 12, wherein the cooled air controlling plate has air discharge outlets corresponding to each of the compartments other than the additional compartment.

14. The apparatus recited by claim 1, wherein the cooled air controlling plate consists of a single element, having multiple outlets.

15. A method for controlling the temperature in various compartments of a refrigeration chamber of a refrigerator, comprising:

presetting a desired temperature for each of the compartments being controlled;

sensing the actual temperature in each of the compartments being controlled;

comparing the actual temperature to the preset temperature in each of the compartments being controlled;

controlling an amount of cooled air introduced into each of the compartments by positioning a cooled air controlling plate based on the difference between the actual temperature and the preset temperature for those respective compartments, said cooled air controlling plate containing a plurality of air discharge outlets for directing the cooled air into said compartments, wherein changes in the actual temperature of the compartments being controlled are monitored and used to control the amount of cooled air introduced into each of the compartments.

16. The method of claim 15, wherein the amount of cooled air is controlled by, setting a supply rate of cooled air to a first compartment at the top of the refrigerating chamber to a "strong" setting position and comparing the existing temperature in the first compartment to the preset temperature therein, comparing the existing temperature in a second compartment to the preset temperature therein, setting the supply rate of cooled air to the second compartment to "strong" if the existing temperature in the second compartment is higher than the preset temperature and setting the supply rate of cooled air to the second compartment to "weak" if the present temperature in the second compartment is lower than the preset temperature, comparing the existing temperature in a third compartment to the preset temperature therein, setting the supply rate of cooled air to the third compartment to "strong" if the existing temperature in the third compartment is higher than the preset temperature and setting the supply rate of cooled air to the third compartment to "weak" if the preset temperature in the third compartment is lower than the preset temperature, comparing the existing temperature in a fourth compartment to the preset temperature therein, setting the supply rate of cooled air to the fourth compartment to "strong" if the existing temperature in the fourth compartment is higher than the preset temperature and setting the supply rate of cooled air to the fourth compartment to "weak" if the existing temperature in the third compartment is lower than the preset temperature, and setting the supply rate of cooled air to a specific value if all of the temperatures in the compartments are lower than the preset temperatures.

17. The method recited by claim 15, further comprising directing the cooling air into an additional compartment in the refrigerator chamber of the refrigerator, the amount of cooling air being directed into the additional compartment not being restricted by an air discharge outlet of the cooled air controlling plate.

18. The method recited by claim 17, wherein the cooled air controlling plate has air discharge outlets corresponding to each of the compartments other than the additional compartment.

19. The method recited by claim 15, wherein the cooled air controlling plate consists of a single element, having multiple outlets.

* * * * *